United States Patent [19]

Barnes, Jr.

[11] Patent Number: 4,786,053

[45] Date of Patent: Nov. 22, 1988

[54] PORTABLE FREE-STANDING APPARATUS FOR MULTIPLE ATHLETIC BALL GAMES

[75] Inventor: Donald B. Barnes, Jr., Missouri City, Tex.

[73] Assignee: McKenzie Brothers Products, Inc., Houston, Tex.

[21] Appl. No.: 15,696

[22] Filed: Feb. 17, 1987

[51] Int. Cl.[4] ..... A63B 63/08; A63B 63/04

[52] U.S. Cl. ..... 273/1.5 R; 273/26 R; 273/29 BB; 273/55 D; 273/127 B; 273/400; 273/410; 273/411; 273/413

[58] Field of Search ..... 273/1.5 R, 1.5 A, 29 A, 273/29 B, 29 BB, 411, 410, 550, 26 E, 26 R, 26 A, 413, 127 B, 398, 400–402

[56] References Cited

U.S. PATENT DOCUMENTS

| | | | |
|---|---|---|---|
| D. 235,361 | 6/1975 | Benton | D21/201 |
| 2,818,254 | 12/1957 | Dunn | 273/1.5 R |
| 2,944,815 | 7/1960 | Moyer | 273/1.5 R X |
| 3,105,682 | 10/1963 | Aherns | 273/413 X |
| 3,119,588 | 1/1964 | Keats | 248/158 |
| 3,216,681 | 11/1965 | Tagliavia | 248/44 |
| 3,399,889 | 9/1968 | Harry | 273/1.5 R |
| 3,669,450 | 6/1972 | Mason | 273/1.5 R |
| 3,716,234 | 2/1973 | Lancellotti | 273/1.5 R |
| 3,743,286 | 7/1973 | Weinhagen et al. | 273/1.5 R |
| 3,841,631 | 10/1974 | Dolan | 273/1.5 R |
| 3,908,992 | 9/1975 | Cunningham | 273/55 D |
| 3,953,029 | 4/1976 | Boyd | 273/411 X |
| 4,145,044 | 3/1979 | Wilson et al. | 273/1.5 R |
| 4,191,372 | 3/1980 | Keller | 273/29 A |
| 4,420,158 | 12/1983 | Klock et al. | 273/127 B X |
| 4,460,172 | 7/1984 | Hogan | 273/26 E X |
| 4,616,834 | 10/1984 | Davis | 273/411 |

FOREIGN PATENT DOCUMENTS

| | | | |
|---|---|---|---|
| 2321436 | 11/1974 | Fed. Rep. of Germany | 273/55 D |

OTHER PUBLICATIONS

The Evening Star; Washington, D.C.; 10/20/1966, p. B-9; Nobody's Kicking Now.

*Primary Examiner*—Paul E. Shapiro
*Attorney, Agent, or Firm*—Vaden, Eickenroht, Thompson & Boulware

[57] ABSTRACT

Apparatus readily useful for setting up to play a plurality of water and yard or court games. The construction comprises a plurality of tubing sections, preferably made of polyvinylchloride. The parts can be glued together in large part so that only one or two pieces need to be changed out to set up for different games or sports. The tubing permits the use of water as the ballasting medium, which is readily available and disposable in most situations.

6 Claims, 4 Drawing Sheets

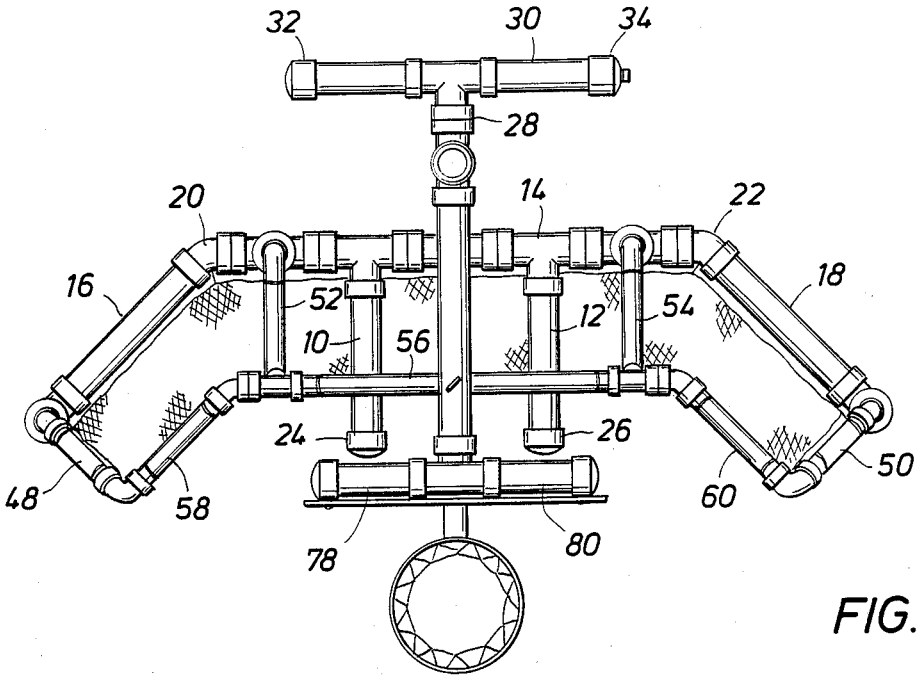
FIG. 2
FIG. 1
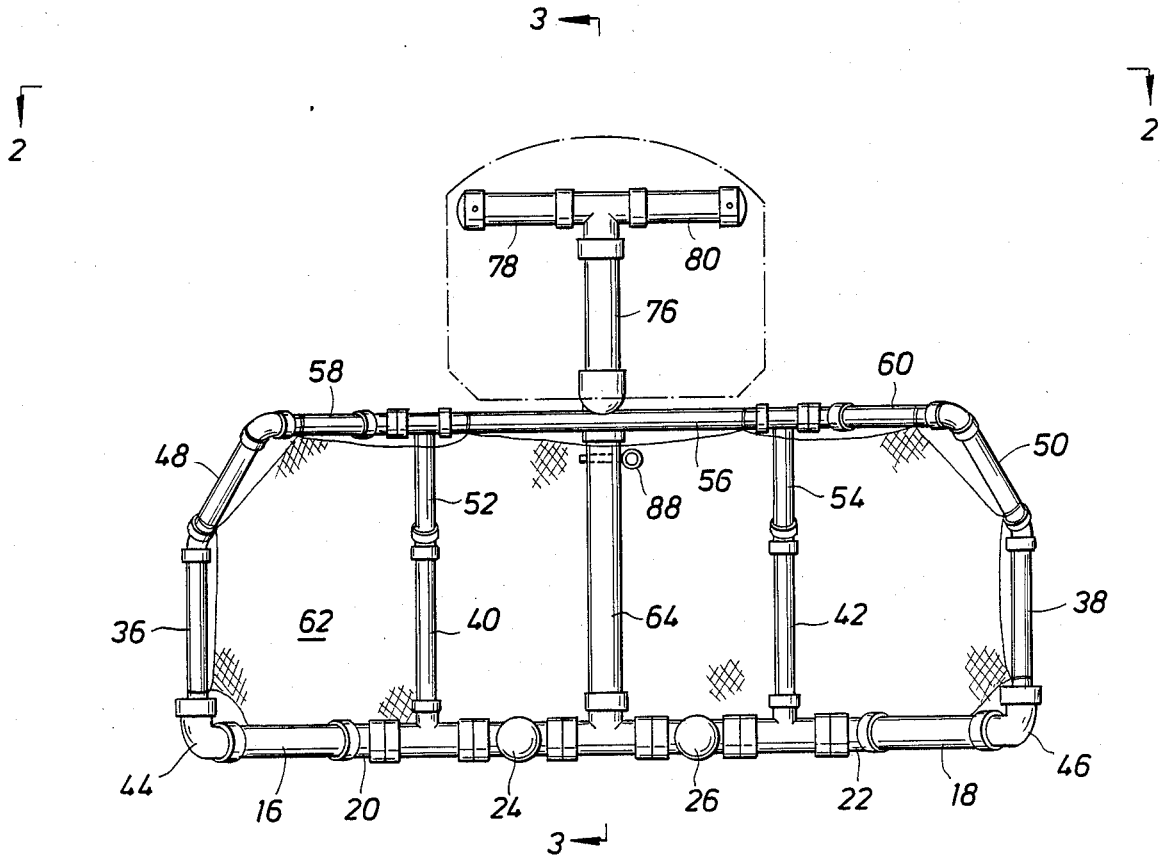

FIG. 5
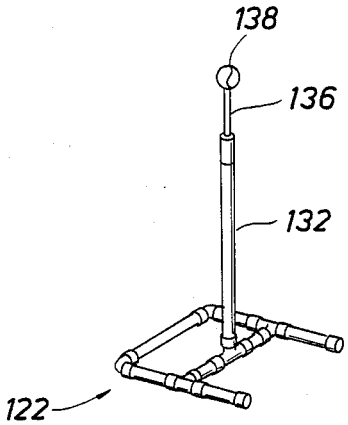
FIG. 6
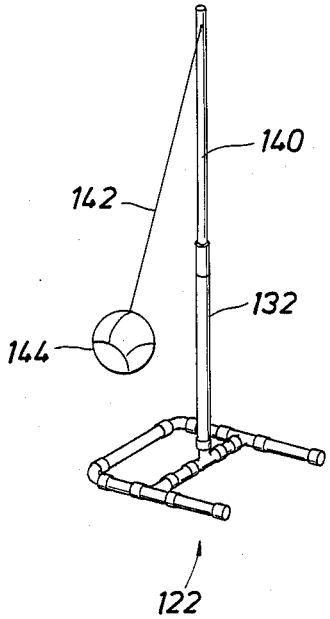
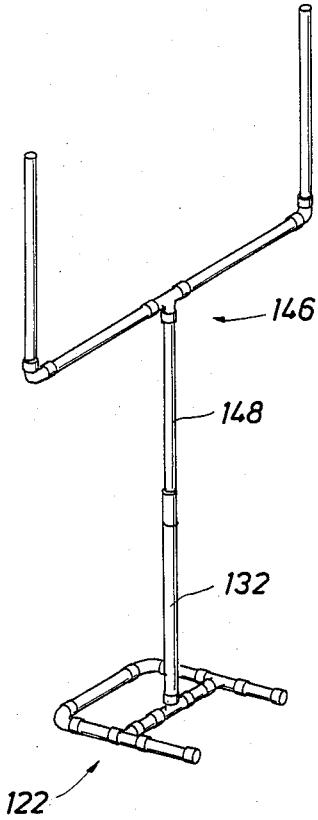
FIG. 7
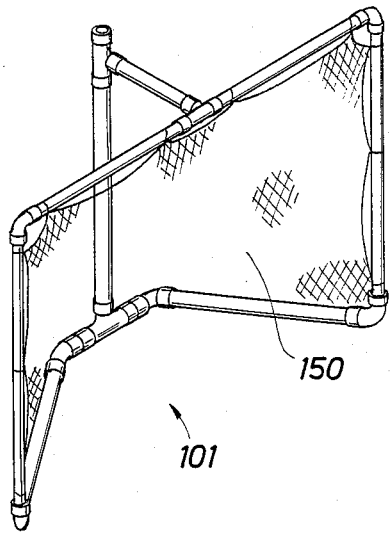
FIG. 8

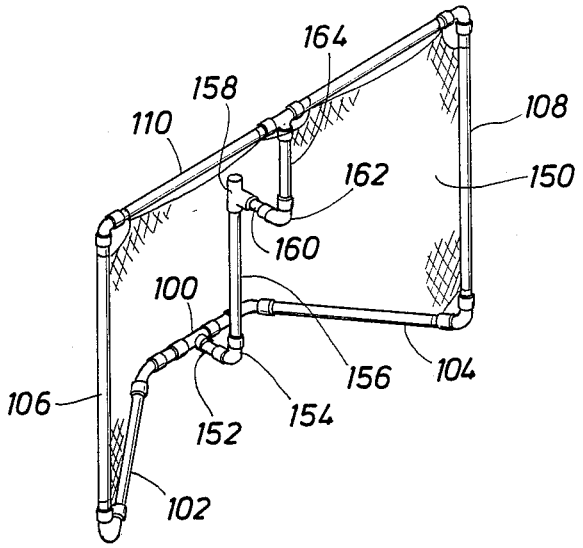
FIG. 9
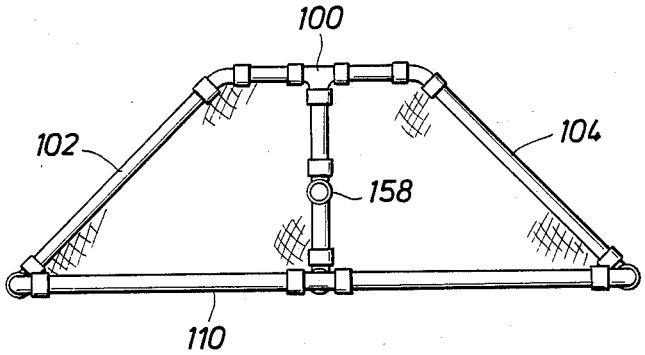
FIG. 11
FIG. 12
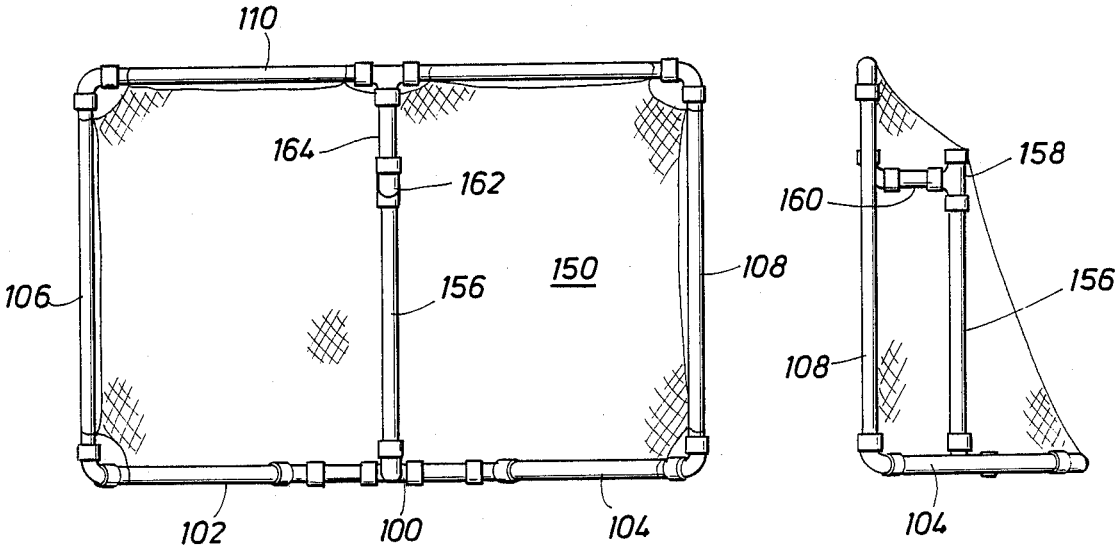
FIG. 10

PORTABLE FREE-STANDING APPARATUS FOR MULTIPLE ATHLETIC BALL GAMES

BACKGROUND OF THE INVENTION

1. Field of the Invention

This invention relates to portable free-standing support structures in playing multiple athletic ball games.

2. Description of the Prior Art

Many athletic ball games, for both swimming pool and yard, require supporting structures for nets, baskets, balls and/or goals. These structures must be given dimensions and require the associated nets, baskets, or goals to be deployed at various heights. The supporting structures that are currently available lack some or all of the characteristics of being free-standing, portable, stable, durable, disassembleable, removable, and multi-functional.

Therefore, it is a feature of the present invention to provide an improved multi-functional supporting structure for elements necessary for the play of athletic ball games, such supporting structure combining the feature of being free-standing, portable, stable, durable, disassembleable, and removable. It is a further feature of the present invention to utilize plastic polyvinylchloride pipe and joints to accomplish the above goals.

It is a further feature of the present invention to provide an improved structure for the above purposes, having stability by permitting ballasting of the structure by filling designated units of pipe with a ballasting material, preferably water.

It is yet a further feature of the present invention to provide an improved structure for the above purposes that are easy to disassemble and are portable by providing accessible and functional drains for the ballasting material such that the ballasting material may be easily added after the structure is in position and easily drained before the unit is carried away.

It is still a further feature of the present invention to provide an improved structure for the above purposes, many of the joints being secured with glue such that the joints do not leak ballasting material.

It is yet a further feature of the present invention to provide an improved single structure for the above purposes that is ameanable to the play of at least two water sport games.

It is still a further feature of the present invention to provide an improved structure for the above purpose having structural configurations of the support of athletic games where the structural configurations are dimensioned at less than regulation size for the play of younger children.

SUMMARY OF THE INVENTION

A portable, free-standing structure is disclosed comprised of multiple sections or units of suitable plastic pipe, preferably polyvinylchloride (PVC) pipe. Plastic joints of the same material are provided to join the units where necessary and end pieces or caps are provided where necessary at the bottom of the structure so that the pipe assembly retains water used as a ballast. An opening at or near to the top of the structure permits the structure to be filled with water. Many of the pieces are permanently joined together since thusly assembled they are always employed in such a condition. Not all of the pieces are used in every assembly, but sufficient pieces are provided for all of the games to be played with the structure.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the drawings, which drawings form a part of this specification. It is to be noted, however, that the appended drawings illustrate only preferred embodiments of the invention and are therefore not to be considered limiting of its scope, for the invention may admit to other equally effective embodiments.

In the Drawings:

FIG. 1 is a front view of a preferred embodiment of the present invention, particularly suited for playing water ball games.

FIG. 2 is a top view of the embodiment shown in FIG. 1, taken at 2—2 of FIG. 1.

FIG. 5 is a pictorial view of a part of the embodiment shown in FIG. 4 set up for playing tee ball.

FIG. 6 is a pictorial view of a part of the embodiment shown in FIG. 6 set up for playing tether ball.

FIG. 7 is a pictorial view of a part of the embodiment shown in FIG. 4 and including additional structure set up for a football field goal.

FIG. 8 is a pictorial view of a part of the embodiment shown in FIG. 4 set up for a soccer or field hockey goal.

FIG. 9 is a pictorial view of another preferred embodiment of the present invention, particularly suited for playing water ball games.

FIG. 10 is a front view of the embodiment shown in FIG. 9.

FIG. 11 is a top view of the embodiment shown in FIG. 9.

FIG. 12 is a right side view of the embodiment shown in FIG. 10.

DESCRIPTION OF THE PREFERRED EMBODIMENT

Figure 3:
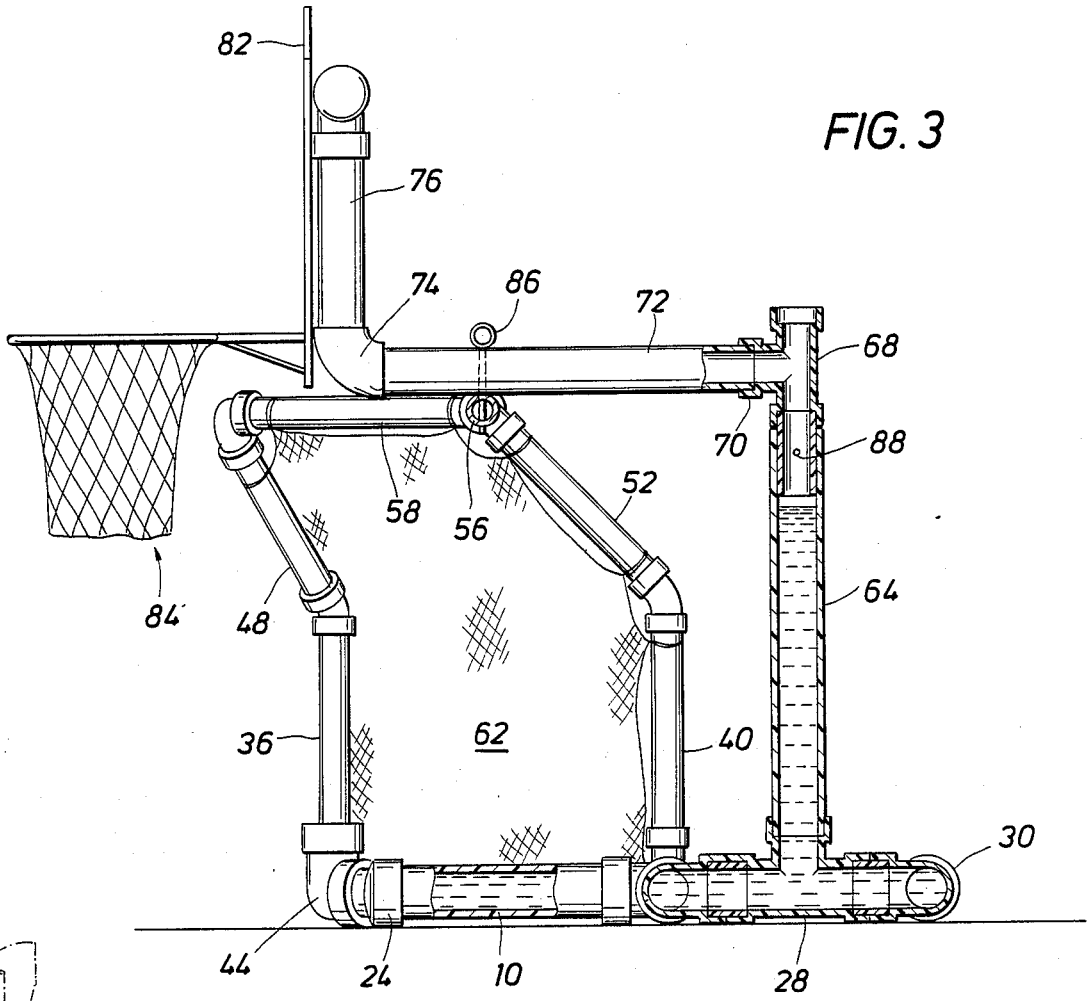
FIG. 3 is a cross-sectional side view of the embodiment shown in FIG. 1, taken at 3—3 of FIG. 1.

"Athletic" is used in this application to imply active sports.

"Ball" is used in this application to mean any sports ball, puck or other object whose passage forms part of the play of the athletic game.

"Cap" is used in this application to mean any seal or cover for the ends of the units of plastic pipe.

"Structural configuration appropriate for the play" is used in this application to mean the type of structures, whether of regulation size or not, used to play an athletic ball game. Examples of such structural configurations would be the structure for securing a basketball backboard and net, the structure for securing a soccer goal net or a hockey goal net, the structure for securing a tennis net or a badminton net or a volleyball net, the structure forming football goal posts, the structuring forming a "T" for "Tee ball" or the structure securing a tether ball.

Now referring to the drawings and first to FIG. 1, an embodiment of the present invention particularly suited for playing water sports is illustrated. Multiple sections of pipes and joints are employed in a double "T" configuration for constructing the base. The twin legs of the "T" are identified by reference numerals 10 and 12 and the cross piece connected to the "T" legs is generally identified by reference numeral 14. It may be seen that cross piece 14 is comprised of several suitable segments of pipe or tubing units and connectors for joining the segments or units together. Connected to the respective ends of cross piece 14 are angled outer legs 16 and 18, respectively. Suitable elbow connectors 20 and 22 are provided to join cross piece 14 with outer legs 16 and 18, respectively, so as to make them join to cross piece 14 at respective obtuse angles. The ends of "T" legs 10 and 12 not joined to cross piece 14 are respectively capped by end pieces or caps 24 and 26. It may be seen from FIG. 1 that the "T" legs, the outer legs and the cross piece all are aligned in a common horizontal plane and together form the base or foundation of the front part for the overall structure. It should be further noted that the dimension of these pieces are larger in diameter than the non-base pieces to be hereafter described.

As may be best shown in FIG. 3, there is an additional part of the structure which is included in the base, namely, rear "T" leg 28 and rear "T" head or cross piece 30. The ends of rear "T" head 30 are capped off by end pieces or caps 32 and 34, respectively.

Generally vertical pieces 36 and 38, at the respective ends, and 40 and 42, intermediate to the ends, are connected to cross piece 14. End pieces 36 and 38 are connected by respective elbow connectors 44 and 46 to legs 16 and 18. Vertical pieces 40 and 42 are inserted into appropriate "T" openings in leg 14. Slant frame pieces 48, 50, 52 and 54 are connected respectively to vertical supports 36, 38, 40 and 42. Again, suitable elbow connectors are employed for making the respective junctions.

Cross piece 56 and outer legs 58 and 60 are attached together by appropriate elbow connectors. Finally, outer legs 58 and 60 are connected by appropriate elbow connectors to respective end slant supports 48 and 50, respectively, to complete the outer frame for holding the net. Cross piece 56 is connected to slant supports 52 and 54 by suitable side or "T" connections in cross piece 56. The parts that have just been described are suitable for supporting an appropriate net 62 for making a water polo goal. The net may be attached to the piping structure at a plurality of points by any convenient means, such as by string ties or straps.

An upright or vertical leg 64 is connected to rear "T" leg 28 behind the net and at the top joins an "L" connecting piece 68. The "L" connector fits into the top of upright leg 64 and has an open end pointing upwards aligned therewith through which the ballasting medium, typically water, is applied. In addition, there is a side opening projection 70 in piece 68 for receiving horizontal support 72. The horizontal pipe is sufficiently long that it extends from side opening projection of the "L" connector to a point beyond or in front of cross piece 56. At this point an elbow connector pointing upwards permits attachment to a vertical support 76, which is part of a "T" frame with side supports 78 and 80 for supporting a basketball backboard 82. Suitable bolts through the backboard and through the pipes 76, 78 and 80 secured by nuts on the backside provide mounting for the backboard. The backboard supports a bracket and basketball net 84 in conventional fashion.

A threshold eyebolt 86 through horizontal support 72 and cross piece 56 secure those two pieces together as shown in FIG. 3. A similar eyebolt 88 through upright leg 64 and "L" connector 68 prevent rotation of this support, also as shown in FIG. 3. Hence, when basketball is being played, the FIG. 3 arrangement will be provided to allow such play. However, when water polo is being played, eyebolt 86 is removed and horizontal support 72 is rotated to the back side where eyebolt 88 can be replaced to hold it in a rearward position.

Another game that can be set up for is water volleyball. The frame with horizontal leg 72 rotated to its rearward position can be used for attaching one side of a volleyball net. The other side can be appropriately attached to a permanent or temporary location on the other side of the water area.

It should be noted that all of the other connectors except those that permit the location of support 72 in the two positions just mentioned are all capable of being connected together permanently, such as by suitable glue well known in the art for connecting pieces of PVC or other pipe together. Of course, one of more of end caps 24, 26, 32 and 34 should be removable or include appropriate stoppered drain plugs to permit deballasting or removal of the water, when appropriate. Please note that water is the normal ballasting means which can be inserted from the open end of connector 68; however, sand or dirt can be used also, if desired.

For knock-down and storage convenience, one or more of the connectors at strategic locations can be left unglued. For example, the junction of leg 28 into cross piece 14 can be such an unglued connecting point, if desired.

The tubing material for the parts of the overall structure are preferably made of polyvinylchloride (PVC), although other materials can be employed. The heavier pieces employed in the base and in pieces 64, 72, 76, 78 and 80 are preferably two inches in diameter, whereas the remainder of the tubing can be smaller, typically, $1\frac{1}{2}$ inches in diameter. In all events, it will be seen that the structure shown and described in its various arrangements provide structural configurations appropriate for the play of the games mentioned.

Figure 4:
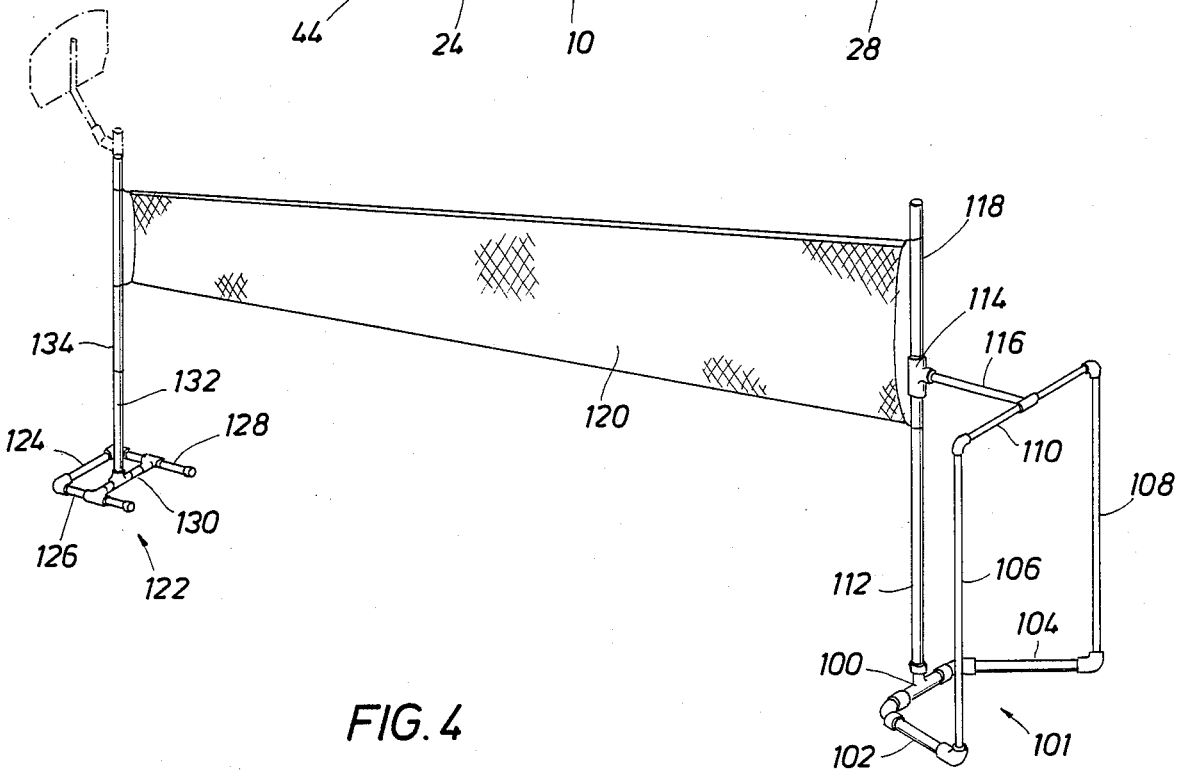
FIG. 4 is a pictorial view of a preferred embodiment of the present invention particularly suited for playing yard ball games.

Now turning to FIG. 4, a similar suitable multi-purpose arrangement using the same type of construction is shown as set up for playing volleyball or badminton in a yard or on pavement. At one end, a large frame 101 is made up of a base including cross piece 100 connected to outer legs 102 and 104 by appropriate elbow connectors so that legs 102 and 104 are at respective obtuse angles with respect to cross piece 100. Together, they lie in a horizontal plane for supporting the large frame.

Vertical supports 106 and 108 are connected to the respective outer ends of legs 102 and 104. Their top ends are joined together by appropriate elbow connections to top cross piece 110.

A rear vertical support 112 is connected into an appropriate side or "T" opening in base cross piece 100. A "T" connector 114 connects to the top of support 112 and includes a side opening for connection to a horizontal support 116, which is connected at its other end into an appropriate "T" connector in the center of top piece 110 of the large frame. Finally with respect to large frame 101, a vertical support 118 is connectable into the top of connector 114. It will be seen that one end of volleyball or badminton net 120 is attached by appropriate means to support 118 above connector 114 and to support 112 below connector 114.

Legs 100, 102 and 104 and supports 112 and 118 are preferably of heavier or larger diameter construction than the remainder of the members of the large frame, as with the construction of the respective similar parts of the embodiment of FIGS. 1–3. That is, the larger tubing is preferably two inches in diameter and the smaller tubing is preferably 1½ inches in diameter.

Opposite to large frame 101 just described is small support 122. Support 122 includes a "T" leg 124 and two side legs 126 and 128 connected together by appropriate elbow connectors to form a generally "U" shape base. A cross piece 130 is connected by appropriate connectors across the open "U" to brace the overall base of the structure in the middle. A vertical support 132 is connected by an appropriate "T" connector in cross piece 130. A second vertical support 134 is connected into the top of support 132, which is long enough to provide the places of attachment for net 120. Finally, the top end of support 134 can accommodate a tubing basketball backboard support, as shown in dotted lines. Alternatively, such basketball backboard apparatus can be supported by the open end of support 118 of the large frame.

Small support 122 is preferably comprised of all larger diameter tubing members, except for vertical support 134, which can be of the smaller tubing size. End caps that are removable or with drain plugs can be provided for closing off both legs 126 and 128.

The top of vertical support 118 and the top of vertical support 134 are open to receive water, sand or other ballasting material. The large frame can be provided with a suitable cap or drain plug at one or more of the connectors in its base or the ballasting material can be removed by turning over the frame so it drains through its input opening.

As will become apparent with the description of FIGS. 5—8, the connectors of the parts can be conveniently permanently glued together for both large frame 101 and small support 122 with the exception of vertical support 118 of the large frame and support 134 of the small support. Moreover, support 112 is conveniently longer than support 132 to accommodate to their respective other sports uses, as hereafter described.

Now referring to FIG. 5, small support 122, without vertical support 134, is shown connected to baseball "tee" support 136. Tee support 136 merely fits into the top of support 132 and includes an upper surface for resting a baseball 138 thereon. It should be noted that the height of the resting ball is made suitable for the user. Hence, more than one tee support 136 can be provided for different size users, if desired.

FIG. 6 shows small support 122, as previously described, with the addition of vertical support 140 attached into its top. Vertical support 140 includes an attachment means, such as a threaded eyebolt, for attachment to a line 142, in turn, attached to tether ball 144.

FIG. 7 shows a football upright attached to small support base 122 previously described. Football uprights or goal posts 146 include a vertically depending support 148 that fits into the top of vertical support 132 in the same manner as previously described for other vertical supports used in the tee ball and tether ball configurations.

Finally, large frame 101 without upper vertical leg 118 is shown in FIG. 8 fitted with a suitable soccer or field hockey or ice hockey net 150. The net is tied or strapped to the tubing at a plurality of locations in conventional fashion.

It has been shown, therefore, that the basic structures first shown in FIG. 4, with only minor additional parts allow for set up of nets for playing volleyball or badminton; goals for playing soccer, field hockey or ice hockey; and supports for the tee baseball, tetherball or football. In addition, large frame 101 and small support 122 can provide support for a tennis net at an appropriate height for this sport. Hence, as with the water sports structure, a structural configuration appropriate for the play of multiple sports is provided.

Now referring to FIG. 9, an alternate preferred embodiment of the invention is illustrated, particularly useful in playing water games. It will be apparent from a comparison of FIG. 9 with FIG. 8, that many of the parts employed in the FIG. 8 embodiment are also employed in the FIG. 9 embodiment, hence there is an economy of parts. The parts that are the same for the two embodiments are numbered the same and need not be further described.

The main differences in the embodiments of FIGS. 9–12 compared with the embodiment of FIG. 8 (also shown in FIG. 4) is in the vertical support system. In FIG. 8, vertical support 112 is located behind open net 150, whereas the vertical support pieces of the FIGS. 9–12 embodiment are located in front of the net. Cross piece 100 is positioned so as to connect with a straight piece 152 at right angles therewith establishing piece 152 to be straight out from cross piece 100. Piece 152 is then connected to an elbow connector 154 which, in turn, is connected to vertical support 156. Vertical support 156 terminates at its upper end in a "T" connector 158, the open end of which is suitable for receiving a depending post on a basketball goal (not shown here, but similar to the connection shown in FIG. 4). Also, the open end permits ballasting with water, as described in previously described embodiments.

From the center of "T" connector 158, a forward piece 160 is connected and thereto an elbow connector 162. Finally, a vertical piece 164 joins connector 162 to top cross piece 110 at the center connection of a "T" connector located at the mid point of piece 110.

It may be seen that the embodiment of FIGS. 9–12 is stabilized by the vertical support system just described being in front of net 150. Hence, many of the larger parts of the FIGS. 1–3 embodiments are not required. Furthermore, the connection to the basketball goal is simplified with respect to the FIGS. 1–3 embodiment.

Although the construction of the embodiments described above permits the set up for regulation play of any of the water games or yard or court games previously described, it is apparent that the equipment can be sized down from such regulation size for play by children or as desired for play even by adults. For example, water basketball is usually not played with a full-size regulation basketball.

It should be further noted that water, the preferred ballasting medium, is generally available. In addition, upon disassembly, water can be emptied and quickly runs off, thereby making the disposal of the medium an easy matter.

While particular embodiments of the invention have been shown and described, it will be understood that the invention is not limited thereto, since modifications can be made and will become apparent to those skilled in the art.

What is claimed is:

1. A portable, free-standing apparatus for playing one or more athletic ball games, comprising a generally "U" shaped base comprised of relatively large diameter pipes adapted to be supported on a horizontal surface with its open side adjacent the side of a pool, and having means through which ballast may be added to or removed from the interior of the pipes, a first open frame mounted on and extending upwardly from and forwardly toward the open side of the "U" shaped base, a backboard mounted on the base near its upper end and supporting a basketball net above the horizontal surface, a second open frame having upright sides mounted on the base and a cross member extending between the upper ends of the sides, and a back-up net attached to the upright sides and cross member of the second frame and the base for disposal rearwardly of the basketball net.

2. Apparatus of the character defined in claim 1, including means by which the first frame may be moved to a position in which the backboard is removed from in front of the net to permit the net to be used as a goal in the playing of water polo.

3. Apparatus of the character defined in claim 2, wherein the first frame includes a first pipe mounted on and extending upwardly from the base, a second pipe rotatably mounted on the first pipe, and a third pipe extending forwardly from the second pipe and having means on its forward end to support the backboard.

4. Apparatus of the character defined in claim 3, wherein the lower end of the second pipe opens to the interior of the base and has an open upper end through which ballast may be introduced.

5. Apparatus of the character defined in claim 1, including means for releasably securing the cross member of the second frame to the first frame.

6. Apparatus of the character defined in claim 1, wherein the pipe of the base are plastic, and the first and second frame are formed of relatively small diameter, light weight tubular members.

* * * * *